US009021815B2

(12) United States Patent
Tschuor et al.

(10) Patent No.: US 9,021,815 B2
(45) Date of Patent: May 5, 2015

(54) GAS TURBINE COMBUSTION DEVICE

(75) Inventors: Remigi Tschuor, Windisch (CH); Bogdan Trbojevic, Karlovac (HR); Urs Benz, Gipf-Oberfrick (CH)

(73) Assignee: Alstom Technology Ltd, Baden (CH)

( * ) Notice: Subject to any disclaimer, the term of this patent is extended or adjusted under 35 U.S.C. 154(b) by 1085 days.

(21) Appl. No.: 13/015,910

(22) Filed: Jan. 28, 2011

(65) Prior Publication Data

US 2011/0185746 A1 Aug. 4, 2011

(30) Foreign Application Priority Data

Feb. 4, 2010 (EP) ..... 10152618

(51) Int. Cl.

| | |
|---|---|
| ***F23R 3/60*** | (2006.01) |
| ***F23R 3/04*** | (2006.01) |
| ***F23R 3/28*** | (2006.01) |
| ***F23R 3/50*** | (2006.01) |

(52) U.S. Cl.

CPC ..... *F23R 3/283* (2013.01); *F23R 2900/03041* (2013.01); *F23R 3/60* (2013.01); *F23R 3/04* (2013.01); *F23R 3/50* (2013.01); *F23R 2900/00012* (2013.01); *F23R 2900/00017* (2013.01); *F23R 2900/03042* (2013.01); *F23R 2900/03044* (2013.01)

(58) Field of Classification Search

CPC ..... F23R 3/002; F23R 3/283; F23R 3/60; F23R 3/04; F23R 3/06; F23R 2900/03041; F23R 2900/03044

USPC ..... 60/752–760

See application file for complete search history.

(56) References Cited

U.S. PATENT DOCUMENTS

| | | | | |
|---|---|---|---|---|
| 5,273,249 | A * | 12/1993 | Peterson et al. | 248/550 |
| 5,509,270 | A * | 4/1996 | Pearce et al. | 60/740 |
| 7,690,207 | B2 * | 4/2010 | Markarian et al. | 60/796 |
| 7,770,397 | B2 * | 8/2010 | Patel et al. | 60/752 |
| 2008/0092546 | A1 * | 4/2008 | Stastny et al. | 60/752 |
| 2008/0236169 | A1 | 10/2008 | Hawie et al. | |
| 2008/0264444 | A1 * | 10/2008 | Minor et al. | 134/3 |
| 2008/0282703 | A1 * | 11/2008 | Morenko et al. | 60/796 |
| 2011/0120132 | A1 * | 5/2011 | Rudrapatna et al. | 60/752 |

FOREIGN PATENT DOCUMENTS

| | | |
|---|---|---|
| EP | 1271059 | 1/2003 |
| EP | 1507121 | 2/2005 |

(Continued)

OTHER PUBLICATIONS

European Search Report for EP Patent App. No. 10152618.4 (Aug. 19, 2010).

*Primary Examiner* — Andrew Nguyen

(74) *Attorney, Agent, or Firm* — Buchanan Ingersoll & Rooney PC

(57) ABSTRACT

The combustion device (1) of a gas turbine includes burners (2) connected to a front plate (5) of a combustion chamber (3). The front plate (5) has, spaced apart from one another, a front sheet (8) and an impingement sheet (7) with aligned holes (11, 12) housing the burners (2). A piston ring (15) is provided between the front sheet (8) and impingement sheet (7) to seal the holes (11, 12). The axial length of the border of the hole (11, 12) of the front sheet (8) and/or impingement sheet (7) is longer than the thickness of the corresponding front sheet (8) and/or impingement sheet (7).

16 Claims, 3 Drawing Sheets

(56) References Cited * cited by examiner

FOREIGN PATENT DOCUMENTS

| | | |
|---|---|---|
| EP | 1741982 | 1/2007 |
| EP | 1767855 | 3/2007 |

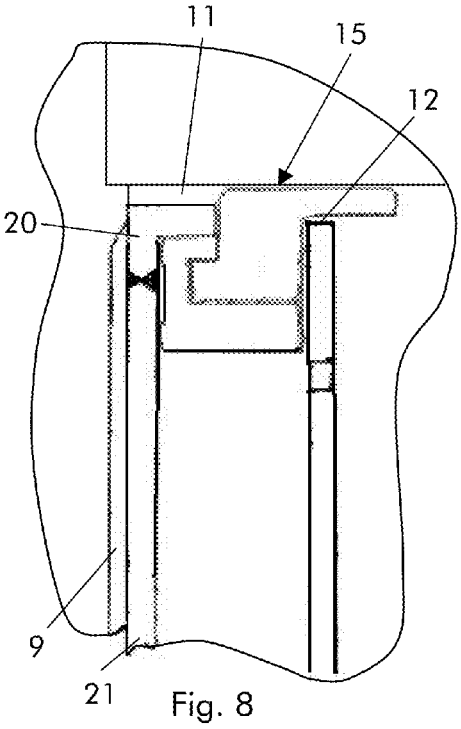
Fig. 8
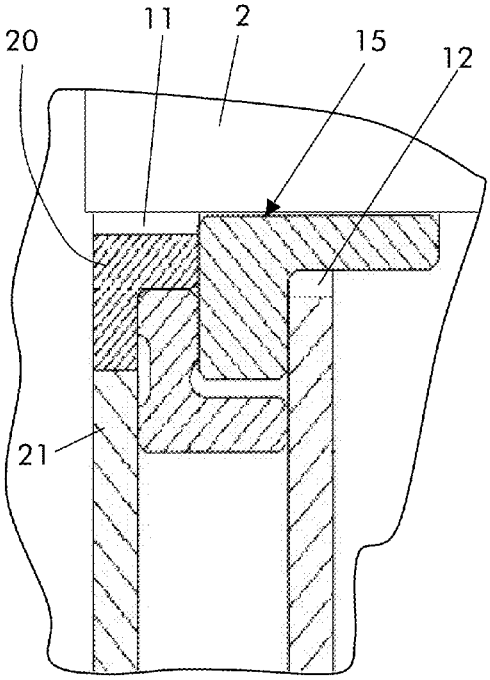
Fig. 9
Fig. 10
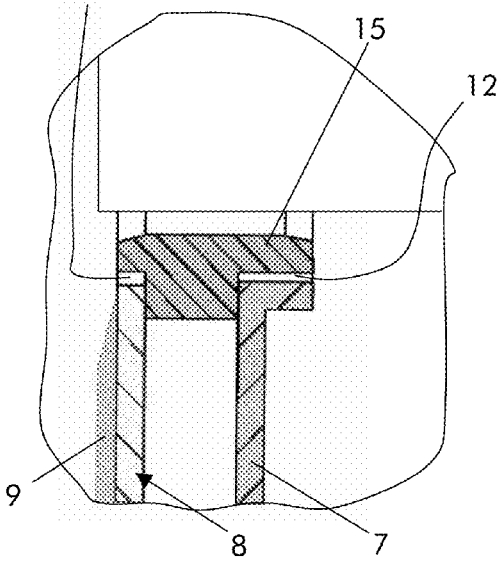
Fig. 11
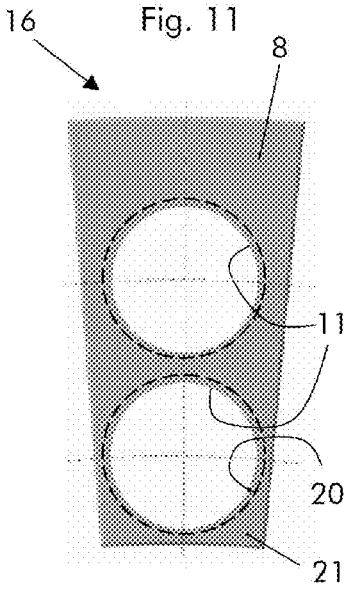

GAS TURBINE COMBUSTION DEVICE

This application claims priority under 35 U.S.C. §119 to European application no. No. 10152618.4, filed 4 Feb. 2010, the entirety of which is incorporated by reference herein.

BACKGROUND

1. Field of Endeavor

The present invention relates to a combustion device of a gas turbine.

2. Brief Description of the Related Art

With reference to FIG. 1, combustion devices 1 have burners 2, wherein fuel is injected into an air flow and mixed therewith, and an annular combustion chamber 3 in which the mixture is combusted.

Typically, a zone of the annular combustion chamber 3 downstream of the burners 2 is delimited by a front plate 5; the casings of the burners 2 are connected to this front plate 5.

With reference to FIG. 2, which shows a traditional front plate 5, the front plate 5 has a perforated impingement sheet 7 and, parallel to and spaced apart from it, a perforated front sheet 8 (usually covered by a heat resistant protection layer 9) that delimits the combustion chamber 3.

The front sheet 8 and the impingement sheet 7 have aligned holes 11, 12 into which the burners 2 are housed, to project (only for few millimeters) into the combustion chamber 3.

For this reason, in order to seal the combustion chamber 3, between the front sheet 8 and impingement sheet 7, and encircling each of the holes 11, 12, a piston ring 15 is provided.

In fact, since the combustion device 1 is housed within a plenum 6 into which compressed air (from the compressor) is supplied, sealing of the combustion chamber is needed to avoid that an amount of air different from the design amount takes part in the combustion, affecting, inter alia, the flame stability and the $NO_x$ emissions.

During operation, the borders of the holes 11 and 12 and the piston ring 15 proved to withstand large damages, due to fretting and wearing.

Damages of those elements may be detrimental to correct operation of the gas turbine, since air in excess of the design amount could enter the combustion chamber, causing the aforementioned drawbacks, such as a reduction of the flame stability and an increase in the $NO_x$ emissions.

SUMMARY

One of numerous aspects of the present invention includes a combustion device by which the aforementioned problems of the known art are addressed.

Another aspect of the invention includes a combustion device having a front plate with front sheets and impingement sheets provided with holes, for housing the burner casings, and piston rings that, during operation, incur reduced damage when compared to existing traditional combustion devices, in particular due to fretting and wearing.

Another aspect of the invention includes a combustion device that allows operation with increased flame stability and reduced emissions (in particular $NO_x$ emissions).

Advantageously, a combustion device in embodiments of the invention and its components has an increased lifetime.

BRIEF DESCRIPTION OF THE DRAWINGS

Further characteristics and advantages of the invention will be more apparent from the description of a preferred but non-exclusive embodiment of the combustion device, illustrated by way of non-limiting example in the accompanying drawings, in which:

FIGS. 3-10 show the holes of the front sheet and impingement sheet, with the piston ring and a casing of a burner in different embodiments of the invention; and FIG. 11 shows an embodiment of a sector constituting the front plate.

DETAILED DESCRIPTION OF EXEMPLARY EMBODIMENTS

Figure 1:
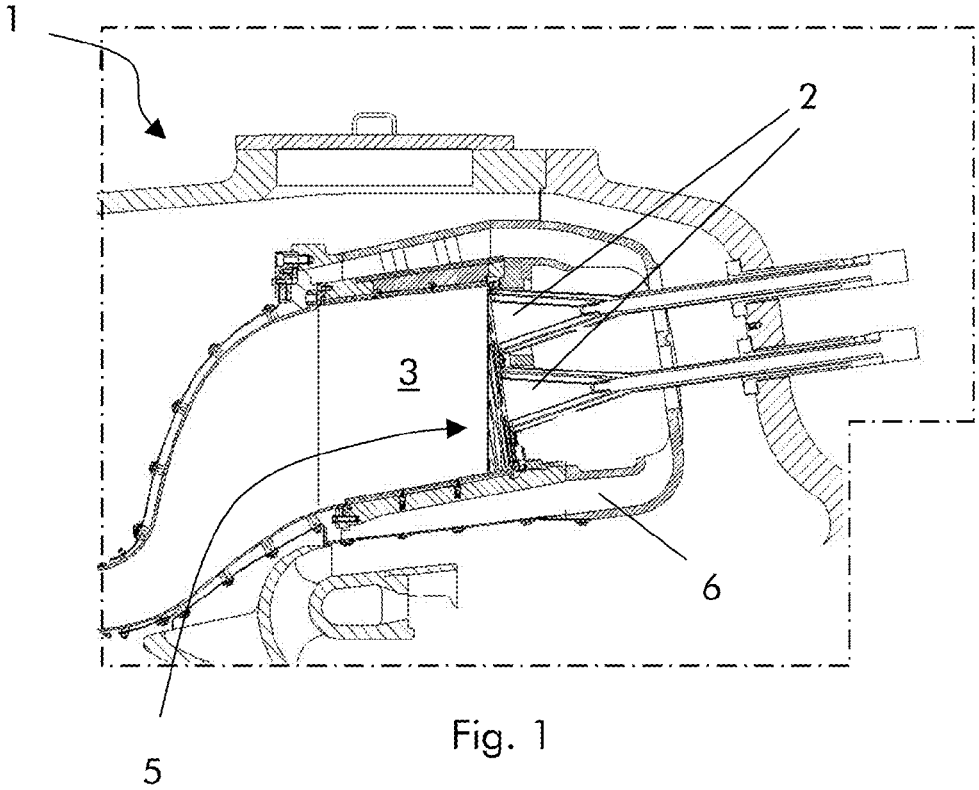
FIG. 1 is a schematic view of a combustion device.
Figure 2:
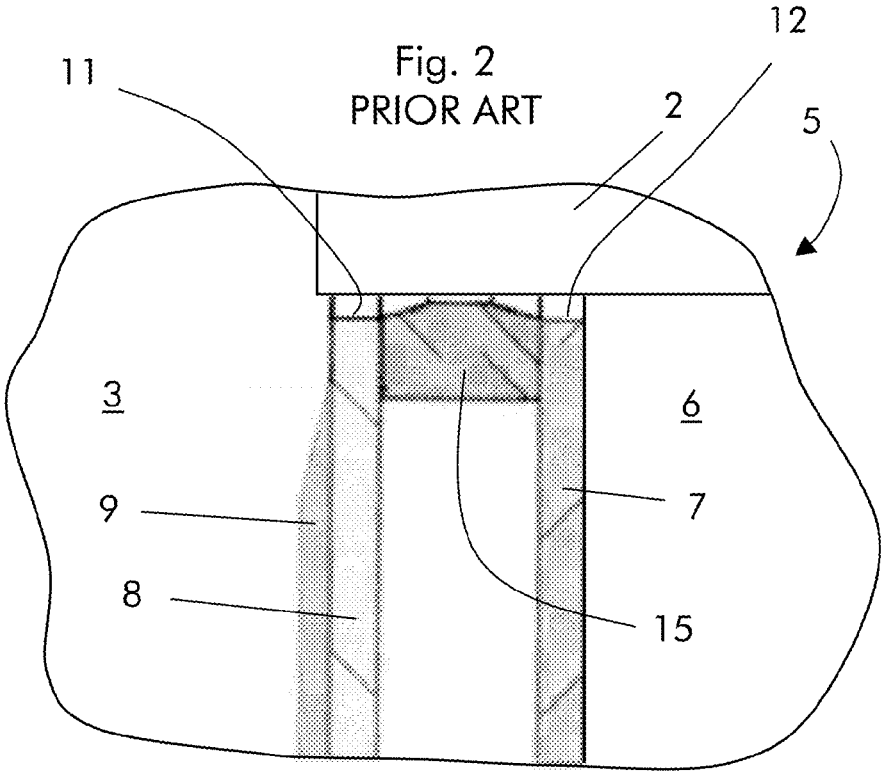
Fig. 2 PRIOR ART
FIG. 2 shows a section view of a front sheet and impingement sheet, with the piston ring and a casing of a burner, in an embodiment of the invention according to the prior art.

With reference to the figures, a combustion device 1 is illustrated; the combustion device 1 has the features already described and, thus, it includes a plurality of burners 2 connected to a front plate 5 of a combustion chamber 3; those components are housed in a plenum 6 into which compressed air (from the compressor) in supplied.

The front plate 5 has an annular structure and is preferably made of a plurality of sectors 16 joined together (FIG. 11 shows one of the sectors); the sectors 16 have a substantially trapezoidal shape.

Each of these sectors 16 has, spaced apart from one another, a front sheet 8 and an impingement sheet 7 with aligned holes (respectively identified by the reference numbers 11 and 12).

Each couple of holes 11 and 12 houses one burner 2.

In addition, a piston ring 15 is provided between the front sheet 8 and impingement sheet 7 to seal the holes 11, 12, preventing compressed air contained in the plenum 6 from entering into the combustion chamber 3.

Advantageously, the axial length of the borders of the holes 11 and/or 12 (i.e., the length of these borders along an axis 18 perpendicular to the corresponding front or impingement sheet 8, 7) is longer than the thickness of the corresponding front sheet 8 and/or impingement sheet 7.

In order to define a border of the holes 11 and/or 12 longer than the thickness of the corresponding front sheet 8 and/or impingement sheet 7, the front sheet 8 and/or impingement sheet 7 are preferably made in two different pieces, one of them defining the holes 11 and/or 12.

In particular, a first piece 20 defining the holes 11 and/or 12 is welded to a second piece 21 defining the main portion of the front sheet 8 and/or impingement sheet 7.

Preferably, the first piece 20 and the second piece 21 define the front sheet 8; in addition a heat resistant protective layer 9 is provided on the side of the front sheet 8 facing the inner of the combustion chamber 3 covering a welding 24 (advantageously an orbital welding) between the first piece 20 and second piece 21.

Advantageously, the border of the hole 11 has a wear resistant protective coating 25 that extends up to the first piece side 26 facing the piston ring 15. Naturally also the hole 12 may be provided with the protective coating 25 also extending up to the second piece side facing the piston ring.

The first piece 20 and the second piece 21 have cooling through holes.

In this respect, the cooling through holes 28 of the first piece 20 may be realized in a portion having the same thickness of the second piece 21 and/or in a portion having a larger thickness thereof and are preferably inclined with respect to a hole axis 30.

As shown, the through holes 28 of the first piece 20 converge towards the inner of the combustion chamber 3.

The cooling through holes 32 of the second piece 21 are preferably parallel to the axis 18.

Moreover, as shown in the figures, the inner diameter of the piston ring 15 is smaller than the inner diameter of the hole 11 of the front sheet 8 that is smaller than the inner diameter of the hole 12 of the impingement sheet 7.

In the following, particular embodiments will be described in detail; the same references are used through all those embodiments to identify identical or similar elements.

Figure 3:
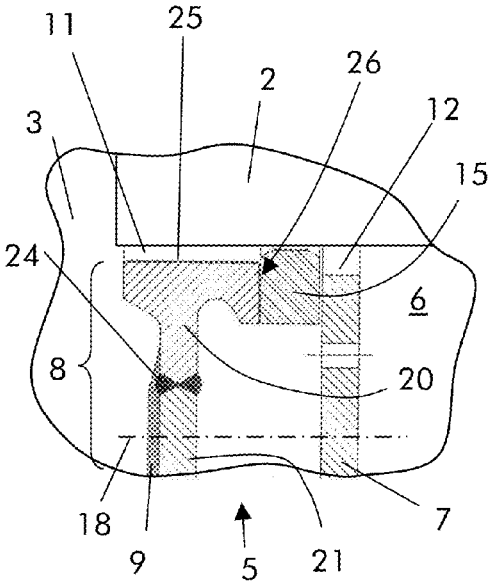

FIG. 3 shows an embodiment with the front sheet 8 made of the first and second pieces 20, 21 and including the heat resistant protective layer 9 extending onto the welding 24. The piston ring 15 is placed between the front sheet 8 and the impingement sheet 7 and does not enter the holes 11 and 12.

Figure 4:
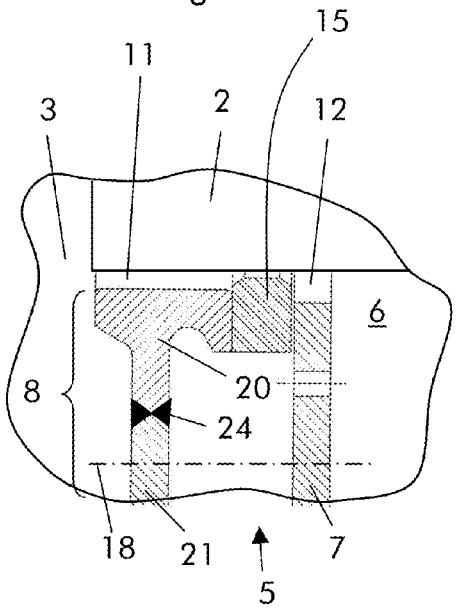

FIG. 4 shows an embodiment similar to the one of FIG. 3; in this embodiment no heat resistant protective layer 9 covering the welding 24 is provided.

Figure 5:
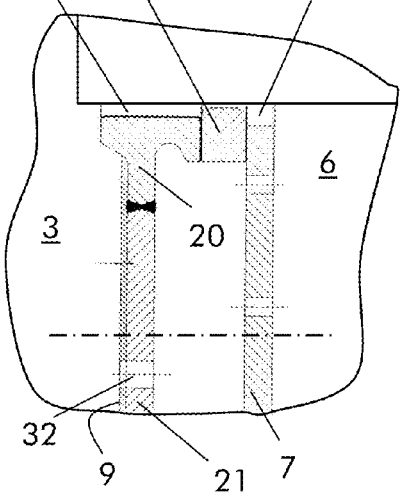

FIG. 5 shows a further embodiment similar to the one of FIG. 3; in this embodiment the cooling through holes 32 of the second piece 21 are shown.

Figure 6:
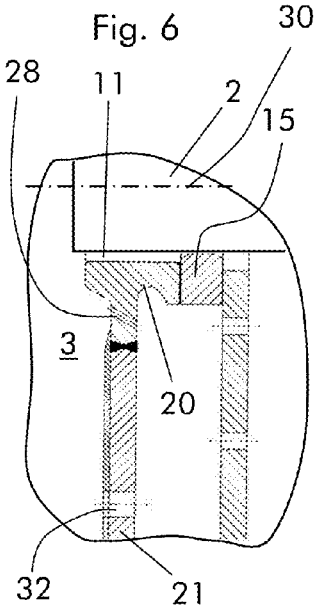

FIG. 6 shows an embodiment similar to the one of FIG. 5; in this embodiment, in addition to the second piece 21 that has the cooling through holes 32, also the first piece 20 has cooling through holes 28. The holes 28 are provided in a zone of the first piece 20 having the same thickness as the second piece 21; moreover they converge towards the inner of the combustion chamber and, in particular, they converge towards the combustion chamber 3 and the axis 30.

Figure 7:
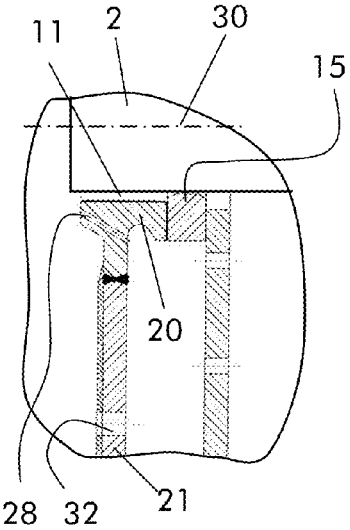

FIG. 7 shows an embodiment similar to the one of FIG. 6; in this embodiment, the holes 28 are provided in a zone of the first piece 20 having a larger thickness than the second piece 21.

FIG. 8 shows an embodiment with the first piece 20 of the front sheet 8 defined by a curved plate and the piston ring 15 made in two elements.

FIG. 9 shows an embodiment similar to the one of FIG. 8, with the elements constituting the piston ring 15 in a different configuration.

FIG. 10 shows an even further embodiment of the invention. In this embodiment the holes 12 of the impingement sheet 7 have a length longer than the thickness of the same impingement sheet 7. In this embodiment, the impingement sheet 7 is made in one element.

Tests showed that surprisingly, during operation, the borders of the holes 11 and 12 and the piston ring 15 incurred much less damages due to fretting and wearing than in traditional configurations.

This allowed reduced air leakage from the plenum 6 into the combustion chamber 3, such that better combustion conditions and lifetime increase are achieved.

Naturally the features described may be independently provided from one another.

In practice the materials used and the dimensions can be chosen at will according to requirements and to the state of the art.

REFERENCE NUMBERS

1 combustion device
2 burners
3 combustion chamber
5 front plate
6 plenum
7 impingement sheet of 5
8 front sheet of 5
9 heat resistant protective layer
11 hole of 8
12 hole of 7
15 piston ring
16 sector
18 axis perpendicular to 7/8
20 first piece
21 second piece
24 welding
25 wear resistant protective coating
26 side of 20
28 through holes through 20
30 axis of 11/12
32 through holes through 21

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A gas turbine combustion device comprising:

a combustion chamber including a front plate; and at least one burner connected to the front plate;

wherein the front plate comprises, spaced apart from one another, a front sheet and an impingement sheet, the front sheet and the impingement sheet including aligned holes receiving the at least one burner, and a piston ring between the front sheet and the impingement sheet to seal the holes;

wherein an axial length of a border of the front sheet hole, of the impingement sheet hole, or of both, is longer than a thickness of the corresponding front sheet, of the corresponding impingement sheet, or of both; and wherein diameters of the holes of the front sheet and impingement sheet are each larger than a diameter of the burner such that during operation the front sheet and impingement sheet are contactable with the burner.

2. The combustion device as claimed in claim 1, wherein the front sheet, the impingement sheet, or both comprise at least two different pieces, one of said at least two different pieces at least partially defining at least one of said holes.

3. The combustion device as claimed in claim 2, wherein the at least two different pieces comprise a first piece defining the hole of the front sheet or the impingement sheet and a second piece defining a main portion of the front sheet or the impingement sheet, the first piece being welded to the second piece.

4. The combustion device as claimed in claim 3, wherein the first piece and the second piece define the front sheet.

5. The combustion device as claimed in claim 4, further comprising:

a heat resistant protective layer on a side of the front sheet facing an inside of the combustion chamber covering the weld between the first piece and the second piece.

6. The combustion device as claimed in claim 3, wherein the border of the front sheet hole, of the impingement sheet hole, or of both comprises a wear resistant protective coating extending up to a side facing the piston ring.

7. The combustion device as claimed in claim 3, wherein the first piece and the second piece comprise cooling through holes.

8. The combustion device as claimed in claim 7, wherein the first piece cooling through holes are inclined with respect to a hole axis.

9. The combustion device as claimed in claim 8, wherein said first piece cooling through holes converge towards the inside of the combustion chamber.

10. The combustion device as claimed in claim 1, wherein the piston ring has an inner diameter smaller than an inner diameter of the front sheet hole, and the inner diameter of the front sheet hole is smaller than an inner diameter of the impingement sheet hole.

11. The combustion device as claimed in claim 1, wherein an axial length of the border of the hole of the front sheet, of the impingement sheet, or of both is parallel to an axis perpendicular to the corresponding sheet.

12. The combustion device as claimed in claim 1, wherein the front plate comprises an annular structure which comprises a plurality of sectors joined together.

13. The combustion device as claimed in claim 12, wherein each of the sectors has a substantially trapezoidal shape.

14. The combustion device as claimed in claim 2, wherein the at least two different pieces define the border of the hole of the front sheet, of the impingement sheet, or of both such that the axial length of the border is longer than the thickness of the corresponding sheet.

15. The combustion device as claimed in claim 1, wherein the impingement sheet has through holes in addition to said hole.

16. The combustion device as claimed in claim 1, wherein the aligned holes of the front sheet and the impingement sheet face a rectilinear section of the burner.

* * * * *